US005479913A

United States Patent [19]

Adams

[11] Patent Number: 5,479,913

[45] Date of Patent: Jan. 2, 1996

[54] DIRECT CONTACT WATER HEATER

[75] Inventor: Charles L. Adams, Fort Worth, Tex.

[73] Assignee: PVI Industries, Inc., Fort Worth, Tex.

[21] Appl. No.: 381,129

[22] Filed: Jan. 31, 1995

Related U.S. Application Data

[63] Continuation-in-part of Ser. No. 143,937, Oct. 27, 1993, Pat. No. 5,437,249.

[51] Int. Cl.[6] ..... F24H 1/20

[52] U.S. Cl. ..... 126/360 R; 126/350 R

[58] Field of Search ..... 126/360 A, 360 R, 126/350 R; 122/4, 31.2

[56] References Cited

U.S. PATENT DOCUMENTS

| | | | |
|---|---|---|---|
| 2,841,136 | 7/1958 | Pettit et al. | 126/360 R |
| 2,982,346 | 5/1961 | Andersen . | |
| 2,987,061 | 6/1961 | Huber | 126/350 R |
| 3,204,629 | 9/1965 | Newton, Jr. . | |
| 3,212,559 | 10/1965 | Williamson | 126/360 A |
| 3,224,431 | 12/1965 | Holden . | |
| 3,251,357 | 5/1966 | Williamson . | |
| 3,386,436 | 6/1968 | Miyahara . | |
| 3,402,985 | 9/1968 | Galvin . | |
| 3,460,895 | 8/1969 | Yamaguchi . | |
| 3,602,440 | 7/1953 | Corns | 126/360 R |
| 3,826,240 | 7/1974 | Miyahara . | |
| 3,837,813 | 9/1974 | Ebeling et al. . | |
| 4,089,629 | 5/1978 | Baumgartner et al. . | |
| 4,127,826 | 7/1992 | Action et al. | 126/91 A |
| 4,275,708 | 6/1981 | Wood . | |
| 4,372,290 | 2/1983 | Visos et al. . | |
| 4,493,309 | 1/1985 | Wedge et al. | 126/91 A |
| 4,545,329 | 10/1985 | Adams . | |
| 4,574,775 | 3/1986 | Lutzen et al. . | |
| 4,596,235 | 6/1986 | Bougard . | |
| 4,658,803 | 4/1987 | Ball et al. . | |
| 4,685,444 | 8/1987 | Durrenberger | 126/360 A |
| 4,753,220 | 6/1988 | Lutzen et al. . | |
| 4,765,280 | 8/1988 | Kobayashi et al. . | |
| 4,846,148 | 7/1989 | Zifferer . | |
| 4,895,136 | 1/1990 | Poppe . | |
| 4,938,204 | 7/1990 | Adams . | |
| 4,981,112 | 1/1991 | Adams et al. | 126/360 R |
| 5,086,731 | 2/1992 | Lockett et al. . | |
| 5,145,354 | 9/1952 | Palm . | |
| 5,168,861 | 12/1992 | Lutzen et al. . | |
| 5,184,949 | 2/1993 | O'Brien . | |
| 5,195,883 | 3/1993 | Hanna et al. . | |
| 5,241,949 | 9/1993 | Collier | 126/91 A |
| 5,293,861 | 3/1994 | Mandeville et al. . | |

*Primary Examiner*—Carroll B. Dority

*Attorney, Agent, or Firm*—Charles D. Gunter, Jr.; Grady K. Bergen

[57] ABSTRACT

A direct contact water heater is provided having an upright, closed cylindrical tank formed from an outer tank shell. The outer tank shell has a top, a bottom and an external sidewall extending between the top and bottom to define an interior of the tank. A combustion chamber is centrally located within the interior of the tank. Combustible fuel is introduced downward from a combustion means into the combustion chamber and is ignited in the presence of air within the combustion chamber to create products of combustion. A plurality of spray nozzles are connected to a water supply to be heated. The spray nozzles are evenly spaced around and along the length of the combustion chamber for directing water from the water supply into the combustion chamber so that more uniform contact of the water is achieved with the products of combustion to facilitate heating of the water.

16 Claims, 2 Drawing Sheets

DIRECT CONTACT WATER HEATER

CROSS REFERENCE TO RELATED APPLICATIONS

This application is a continuation-in-part of the earlier filed application Ser. No. 08/143,937, filed Oct. 27, 1993, entitled "Combination Burner and Flue Gas Collector For Water Heaters and Boilers," which is presently U.S. Pat. No. 5,437,249.

BACKGROUND OF THE INVENTION

1. Field of the Invention

This invention relates to a direct contact water heater or boiler having an internal combustion chamber wherein water to be heated comes into contact with a flame of the internal combustion chamber, and in particular to a direct contact water heater or boiler having an improved configuration for more uniform distribution of heat and water within the combustion chamber to facilitate and provide more efficient heat transfer.

2. Description of the Prior Art

Direct contact water heaters or boilers are water heaters in which water to be heated comes in contact with a flame or products of combustion located within a combustion chamber to provide heat transfer. These direct contact water heaters are usually of similar construction consisting of a tank or column in which a collection area or sump is provided at the lower end or bottom of the tank. Located above this is a combustion chamber which is provided with a burner unit. The burner unit produces a flame which is usually directed laterally within the combustion chamber. Above the combustion chamber is typically located a bed or section of packing material to provide increased surface contact for heat transfer. The packing material is formed from non-combustible, heat absorbing materials such as ceramic, metal or glass. Water to be heated is introduced at the top of the tank or column above the bed of packing material and is allowed to percolate to the combustion chamber. As the water percolates or cascades through the packing material, heat is transferred from the hot gasses of combustion and the packing material so that the temperature of the water is raised. The water is further heated as it passes through the combustion chamber itself to the sump where it is collected.

These prior art water heaters have many limitations. Because most direct contact water heaters utilize a laterally directed flame which may only partially fill the combustion chamber, only a portion of the water may actually come into contact with the flame as it passes through the combustion chamber. Thus, heat transfer is achieved primarily within the bed of packing material. The use of packing material is inefficient due to the higher amounts of energy are required to heat and maintain the temperature of the packings. The packings are also heavy and take up space which adds to the weight and size of the water heater.

It is the general object of the present invention to provide a water heater with improved contact of water with the flame within the combustion chamber for more efficient heat transfer and to eliminate the need for a bed of packing material.

Another object of the present invention is to provide such a direct contact water heater which is relatively simple in design and economical to manufacture.

Another object of the invention is to provide an improved heat source for such a direct contact water heater which combines the functions of prior art burner and flue gas collector components of such water heaters.

SUMMARY OF THE INVENTION

A direct contact water heater is shown which provides a more efficient and uniform contact of water to be heated with products of combustion and which eliminates the need for a bed of packing material of the type used in prior art designs. The water heater of the invention includes an upright, closed tank formed from an outer tank shell having a top, a bottom and a generally cylindrical sidewall which extends between the top and bottom to define an interior of the tank. Combustion means, mounted to the top of the tank, includes supply means for supplying fuel from a fuel source and an ignition means for igniting the fuel to form products of combustion.

A combustion chamber is centrally located within the interior of the tank for receiving the products of combustion. The combustion chamber has a longitudinal axis which extends downward within the tank interior. Combustible fuel is introduced downward from the combustion means into the combustion chamber and is ignited in the presence of air to create products of combustion in the form of a downwardly directed flame.

The water to be heated is supplied to the tank interior from a supply source by means of a plurality of spray nozzles which are spaced evenly along the length and about the perimeter of the combustion chamber. In this way, water is directed from the water supply into the tank interior generally perpendicular to the longitudinal axis of the combustion chamber.

Additional objects, features and advantages will be apparent in the written description which follows.

DETAILED DESCRIPTION OF THE PREFERRED EMBODIMENT

Although the preferred embodiment of the invention will be described in terms of a "water heater" suitable for commercial or residential use, the invention has application to other gas, oil and gas/oil fired appliances. In this discussion, the term "water heater" will be understood to encompass both water heaters and "boilers" of the type utilized for commercial/industrial use, as well as for residential use.

Figure 1:
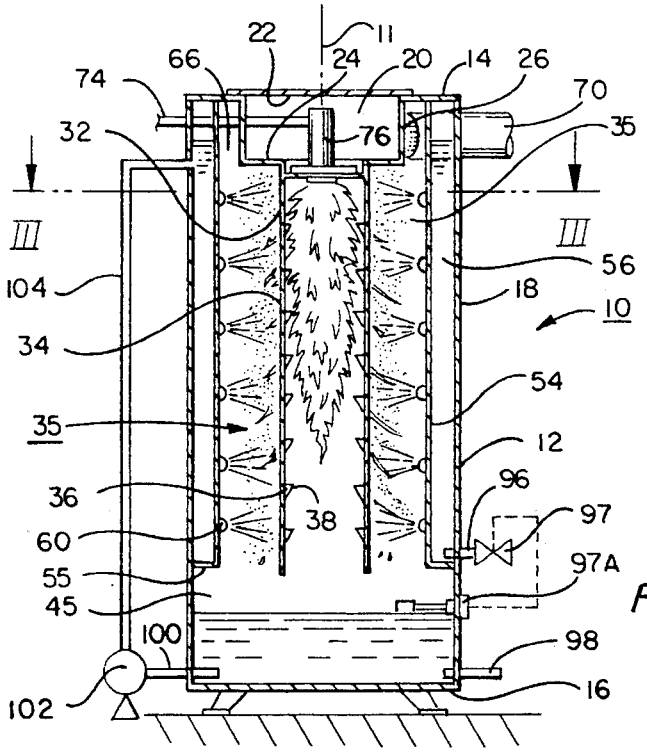
FIG. 1 is a side, cross-sectional view of a water heater constructed in accordance with the invention.

FIG. 1 shows a water heater 10 comprised of a generally cylindrical, closed tank formed from an outer tank shell 12. The outer tank shell 12 has a longitudinal axis 11 and extends between a top 14 and a bottom 16 which are spaced apart and joined together by a cylindrical sidewall 18 to define a closed interior of the tank 12. The tank 12 also has an upper portion (generally at 13 in FIG. 4) and a lower portion (generally at 15 in FIG. 4).

Figure 2:
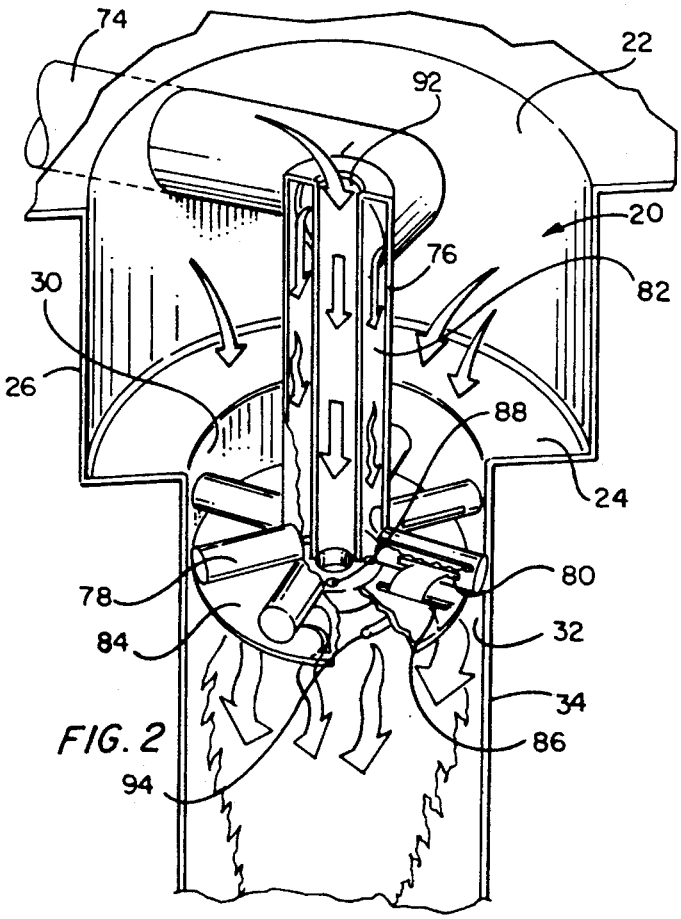
FIG. 2 is an isolated, cut away view of a combustion means for the water heater of FIG. 1 constructed in accordance with the invention.

Mounted to the top 14 of the tank 12 is a burner unit comprised of a closed compartment 20 formed from upper and lower walls 22, 24 (FIG. 2). The upper and lower walls 22, 24 are joined together by an annular sidewall 26. The upper wall 22 is removably bolted or fastened to the top 14 of the tank 12 to access the interior of the closed compartment 20. The lower wall 24 is provided with a central opening 30 which is concentric with the external, cylindrical sidewall 18. Extending downward from the central opening 30 is a blast tube 32 which is formed from a cylindrical metal tube. The blast tube 32 extends downwardly for a selected distance from the central opening 30.

A cylindrical, metal flame tube 34 is joined to and extends downwardly from the blast tube 32 into a combustion chamber 35 of the water heater 10. The flame tube 34 is hollow and is provided with a plurality of circumferentially spaced apertures 36 which extend along the length of the flame tube 34. The apertures are preferably arranged in a regular and symmetrical pattern about the flame tube 34. Provided with each of the apertures 36 are shovel-like projections 38 which are directed upward from the lower edge of each aperture 36 and inward into the interior of the flame tube 34. The projections 38 aid in directing products of combustion from the interior of the flame tube 34 outward through the apertures 36.

Figure 4:
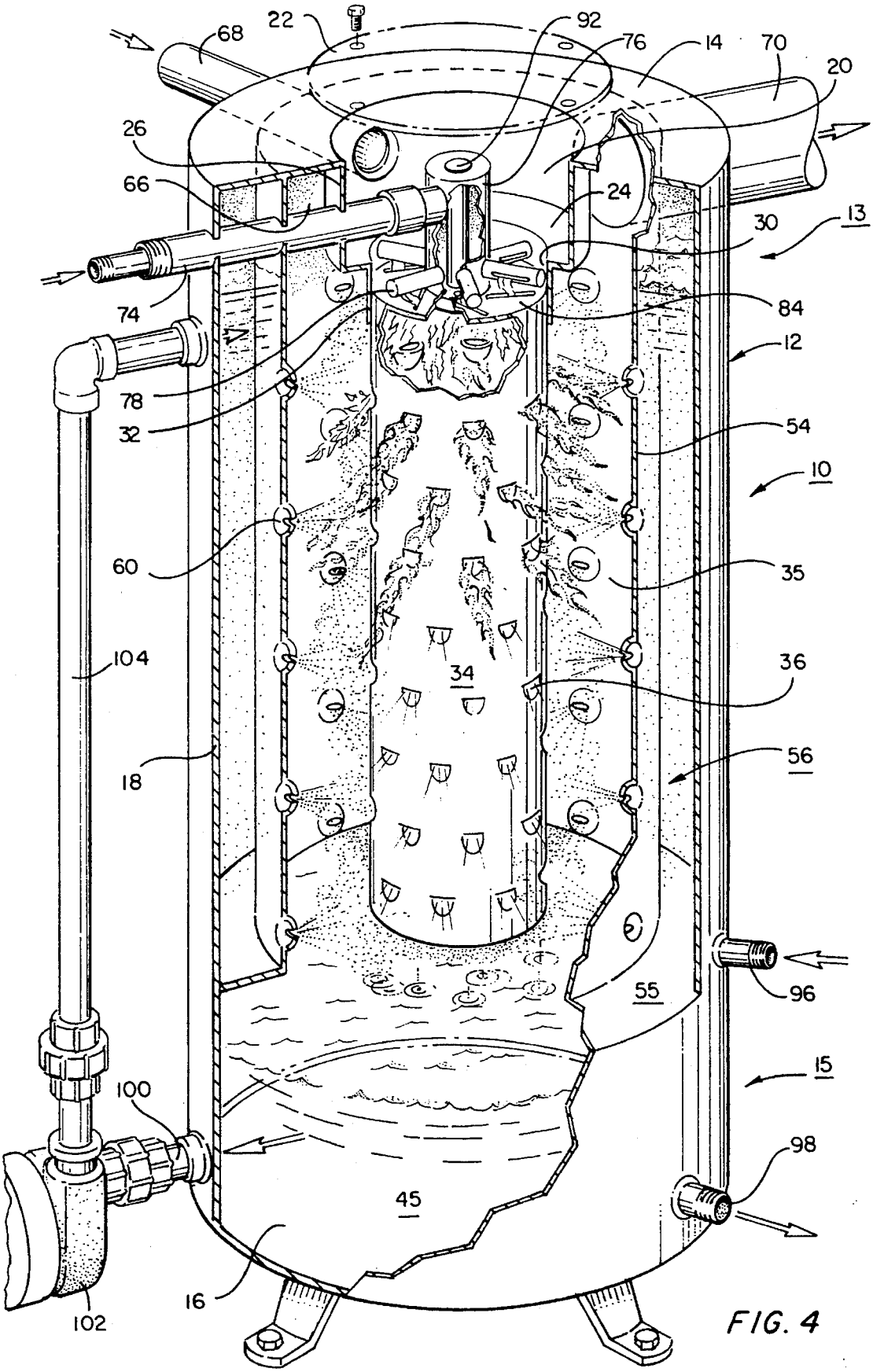
FIG. 4 is a perspective view of the water heater of FIG. 1, partially cut away to show the interior of the water heater.

As can be seen in FIG. 4, the lower end of the flame tube 34 terminates slightly above the lower portion 15 of the tank 12. The lower portion 15 of the tank 12 is watertight to form a collection area or sump 45 for collecting and storing the heated water.

Figure 3:
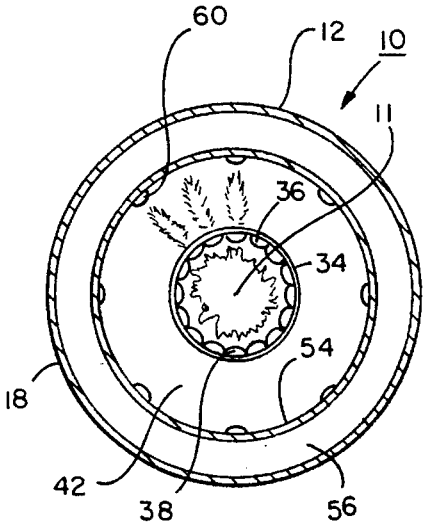
FIG. 3 is a cross-sectional top plan view of the water heater of FIG. 1 taken along the lines III—III in FIG. 1.

Spaced radially inward from the outer shell 12 is a cylindrical inner wall 54 which is joined at its lower end to the innermost edge of an annular shelf 55 located above the sump 45 which projects inward from the interior of the outer shell 12. The inner wall 54 is preferably formed from a thermally conductive material, such as steel. The inner wall 54 extends upward from the shelf 55 parallel with the inner surface of the outer shell 12 to define an annular reservoir 56 of the water heater 10. Provided with the inner wall 54 are a plurality of spray nozzles 60. As shown in FIG. 3, each of the spray nozzles 60 are circumferentially spaced apart approximately 45° around the entire perimeter of the combustion chamber 35. The spray nozzles 60 are also spaced along the length of the inner wall 54, as shown in FIGS. 1 and 4, so that water from the annular reservoir 56 is directed inwards towards the center of the water heater 10 along the entire length of the combustion chamber 35. As shown in FIG. 3, the spray nozzles 60 form a regular and symmetrical spaced arrangement with regard to the longitudinal or central axis 11 of the tank 12.

The upper end of the inner wall 54 is free of spray nozzles and longitudinally overlaps the exterior of the annular sidewall 26 of the closed compartment 20 to provide an annular exhaust chamber 66. Passing through the upper end of the outer shell 12, the inner wall 54, the annular exhaust chamber 66 and the annular sidewall 26 of the closed compartment 20 is a blower conduit 68. The blower conduit 20 opens into the interior of the closed compartment 20 and is connected at its opposite end to a blower (not shown) located exterior to the tank 12. The conduit 68 supplies pressurized air to the interior of the closed compartment 20.

An exhaust flue 70 opens into the annular exhaust chamber 66. The exhaust flue 70 extends through both the inner wall 54 and the outer shell 12 to the exterior of the water heater 10 for exhausting gasses from the upper end of the combustion chamber 35.

As seen in FIG. 4, the burner unit further comprises a fuel supply conduit 74 which extends through the outer tank shell 12, inner wall 54 and annular sidewall 26 into the interior of the closed compartment 20 and terminates in an inner end 76. The inner end or conduit 76 has an upper end which is joined to the conduit 74. The inner conduit 76 is oriented at an angle to that portion of the flue supply conduit 74 extending through the annular sidewall 26 so that the lower end of the inner conduit 76 is directed downward through the central opening 30 into the blast tube 32. The inner conduit 76 is provided with a plurality of radially extending fingers or spiders 78. The spiders 78 are located at the lower end of the inner conduit 76 within the blast tube 32. Each finger or spider 78 has an opening or slit 80. The spiders 78 are in fluid communication with an annular chamber 82 (FIG. 2) of the inner conduit 76. The annular chamber 82 of the inner conduit 76 allows passage of fuel from the fuel supply conduit 74 to the spiders 78.

A pressure plate 84 is mounted to the lowermost extremity of the inner conduit 76 directly below the spiders 78 and is provided with a plurality of apertures or radial extending slits 86. The pressure plate 84 locates and is closely received within the blast tube 32 to facilitate the pressurization of the closed compartment 20 when air is received from the blower conduit 68.

The inner end 76 of the fuel supply conduit 74 also includes a plurality of fuel supply openings 88 which supply fuel from the annular chamber 82 downstream of the pressure plate 84. The annular chamber 82 of the inner conduit 76 defines a central bore 92 which allows air from the closed chamber 20 to pass through the inner end 76 of the conduit 74 to the downstream side of the pressure plate 84. Ignition means is provided by electrodes 94 which are connected to conventional circuitry for producing a timed spark on the downstream side of the pressure plate 84 for igniting the fuel and air mixture to produce products of combustion.

Provided with the water heater 10 is a cold water inlet 96 which passes through the outer shell 12 and empties into the interior of the annular reservoir 56. The cold water inlet 96 is provided with a control valve 97 connected to suitable float control 97A located in the sump 45. The control valve 97 may also be a conventional float valve which is opened or closed by the fall or rise of the water within the sump 45. A hot water outlet 98 is formed in the outer shell 12 and opens into the sump or collection area 45 for drawing heated water from the water heater 10. The sump 45 is also provided with a second outlet 100 connected to a recirculation pump 102 which allows water within the sump 45 to be recirculated through conduit 104 into the annular reservoir 56 when the temperature of the water within the sump 45 drops below a preselected value.

The operation of the water heater 10 is as follows. Initially, the annular reservoir 56 is filled with water from a pressurized water source which is supplied through conduit or inlet 96 by a pump (not shown) or other means. Pressurized air is provided by means of the blower (not shown) through conduit 68. The blower may be located at a remote location from the water heater 10. The air from conduit 68 empties into the closed compartment 20. The pressure plate 84 within blast tube 32 prevents the rapid escape of air through the central opening 30 and blast tube 32 so that the compartment 20 is pressurized.

Fuel is supplied from fuel supply conduit 74 to the annular chamber 82 of the inner end 76. The fuel may be any suitable fuel, such as natural gas. The fuel passes through the annular chamber 82 and exits spiders 78 through slits 80. Fuel also exits through the fuel supply openings 88 to the downstream face of the pressure plate 84 within the blast tube 32. Gas exiting the slits 80 of the spiders 78 is mixed with air within the closed chamber 20 and passes through the slits or apertures 86 of the pressure plate 84 to continue downstream within the blast tube 32. Air is further supplied through central bore 92 to the downstream side of the pressure plate 84 within the blast tube 32.

Electrical current from a suitable electrical power source is supplied to the electrodes 94 mounted to the downstream face of the pressure plate 84 in known fashion. The current to the electrodes creates sparks on the downstream side of the pressure plate 84 causing combustion of the fuel/air mixture within the flame tube 34. The resulting flame is directed downward substantially along the longitudinal axis of the tank 12 through the interior of the flame tube 34 and out through the apertures 36 into the remainder of the combustion chamber 35. The combustion products eventually exit the combustion chamber 35 through the annular exhaust chamber 66 and out the exhaust flue 70 to the exterior of the water heater 10.

As this is occurring, water from the annular reservoir 56 is directed radially inward through the spray nozzles 60 generally transverse to the longitudinal axis of the tank 12 and into the combustion chamber 35 towards the flame tube 34. Contact of the sprayed water with the heated gasses of combustion results in heating of the water. Heat transfer also occurs as amounts of water contact the exterior of the flame tube 34. The heated water falls by gravity from the combustion chamber 35 to the sump 45 below where it is collected and stored. It should be noted that heat from the combustion chamber 35 is also transferred through the inner wall 54 so that water held within the annular reservoir 56 is heated slightly prior to entering the combustion chamber 35. As heated water fills the sump 45, the control means 97A will detect when the water reaches a preselected level, shutting valve 97 so that water is no longer supplied to the water heater 10. If necessary, water from the sump 45 may be drawn through outlet 100 and recirculated by means of the recirculation pump 102 through conduit 104 into the annular reservoir 56 for further heating to maintain the temperature of the water. When the level of water within the sump 45 drops below a preselected level, the control means 97A will cause the control valve 97 to open so that more water is supplied to the annular reservoir 56 for heating as previously described.

The direct contact water heater of the invention has several advantages over the prior art. It is simple in design and can be easily constructed. Because the flame is directed downward within the center of the combustion chamber and the spray nozzles are uniformly distributed around the perimeter of the combustion chamber, more contact of the water with the flame occurs resulting in more heat transfer between the water and products of combustion within the combustion chamber. Water is also heated within the annular reservoir so that the temperature of the water is raised prior to entering the combustion chamber. This also allows there to be less contact with the flame to bring the water to the desired temperature. The water heater of the invention eliminates the need for the packed bed used in prior art water heaters. As a result, the water heater can be reduced in weight and size to heat a given amount of water.

While the invention is shown in only one of its forms it should be apparent to those skilled in the art that it is not so limited but is susceptible to various changes without departing from the scope of the invention.

I claim:

1. A water heater comprising:

an upright, closed tank formed from an outer tank shell having a top, a bottom and a generally cylindrical external sidewall extending between the top and bottom to define an interior of the tank, the tank interior having an upper portion and a lower portion, and the tank having a longitudinal axis extending between the top and bottom of the tank;

combustion means located in the upper portion of the tank, the combustion means including supply means for supplying fuel from a fuel source and ignition means for igniting the fuel to form products of combustion;

a combustion chamber having a length and a periphery, the combustion chamber being centrally located within the interior of the tank, combustible fuel being introduced downward from the combustion means into the combustion chamber and ignited in the presence of air within the combustion chamber to create products of combustion; and a plurality of spray nozzles which are connected to a water supply to be heated, the spray nozzles being evenly spaced along the length and about the periphery of the combustion chamber for directing water from the water supply transversely into the combustion chamber so that the water uniformly contacts the products of combustion within the combustion chamber thereby causing the water to be heated.

2. The water heater of claim 1, wherein:

the spray nozzles are evenly spaced at a plurality of circumferential locations and at a plurality of vertical heights within the tank interior.

3. The water heater of claim 1, wherein said combustion chamber includes an annular inner wall located interior to the external sidewall of the outer tank shell to define an annular reservoir for holding the water supply, the annular reservoir having an inlet which passes through the external sidewall for supplying water to the annular reservoir from an external source.

4. The water heater of claim 3, wherein:

the inner wall is formed from a thermally conductive material to facilitate heat transfer to the annular reservoir for heating the water supply held within.

5. The water heater of claim 1, wherein:

the lower portion of the tank is watertight and defines a collection area for collecting and storing heated water within the tank from the combustion chamber.

6. The water heater of claim 1, wherein the combustion means comprises:

a closed compartment having an upper wall and an opposite lower wall which are spaced apart and joined together by an annular sidewall, the closed compartment being mounted to the top of the tank, the lower wall being provided with a central opening which is in fluid communication with the combustion chamber;

a blower duct which passes to the closed compartment for pressurizing the closed compartment when the duct is connected to an external source of air pressure; and a pressure plate having a plurality of apertures located within a blast tube which extends from the central opening of the closed chamber to thereby facilitate the pressurization of the closed chamber by air entering the chamber through the blower duct; and wherein the supply means for supplying fuel to the combustion chamber is a fuel supply conduit connected to a source of combustible fuel at an upper end and having an lower end which extends within the central opening provided within the lower wall of the closed compartment.

7. The water heater of claim 6, wherein:

the lower end of the fuel supply conduit includes a plurality of radially extending fingers, each finger having an opening therein for supplying fuel to the central opening of the closed compartment at a location upstream of the pressure plate.

8. The water heater of claim 7, wherein:

the inner end of the fuel supply conduit also includes a plurality of fuel supply openings located on a downstream side of the pressure plate.

9. The water heater of claim 1, wherein:

the combustion chamber is provided with a flame tube which extends downward from the combustion means, the flame tube having an interior in which the combustible fuel is introduced from the combustion means to create products of combustion, the flame tube having a plurality of apertures for allowing passage of the products of combustion to an exterior of the flame tube.

10. A water heater comprising:

an upright, closed cylindrical tank formed from an outer tank shell having a top, a bottom and a cylindrical sidewall extending between the top and bottom to define an interior of the tank, the tank interior having an upper portion and a lower portion, and the tank having a longitudinal axis extending between the top and bottom of the tank;

combustion means located at the upper portion of the tank, the combustion means including supply means for supplying fuel from a fuel source, and ignition means .for igniting the fuel to form products of combustion;

a combustion chamber which is centrally located within the interior of the tank, combustible fuel being introduced downward from the combustion means into the combustion chamber and ignited in the presence of air within the combustion chamber to create products of combustion;

said combustion chamber including a cylindrical inner wall which is spaced radially inward from the cylindrical sidewall of the outer tank shell to define with said cylindrical tank an annular reservoir for holding water; and a plurality of spray nozzles which are in fluid communication with the annular reservoir, the spray nozzles being evenly spaced along a length and about a periphery of the combustion chamber for directing water radially inward from the annular reservoir into the combustion chamber so that the water uniformly contacts the products of combustion within the combustion chamber thereby causing the water to be heated; and wherein the lower portion of the tank is watertight and defines a collection area for collecting and storing heated water within the tank from the combustion chamber.

11. The water heater of claim 10, wherein the combustion means comprises:

a closed compartment having an upper wall and an opposite lower wall which are spaced apart and joined together by an annular sidewall, the closed compartment being mounted to the top of the tank, the lower wall being provided with a central opening which is in fluid communication with the combustion chamber;

a blower duct which passes to the closed compartment for pressurizing the closed compartment when the duct is connected to an external source of air pressure; and a pressure plate having a plurality of apertures located within a blast tube which extends from the central opening provided in the lower wall portion of the closed chamber to thereby facilitate the pressurization of the closed chamber by air entering the chamber through the blower duct; and wherein the supply means for supplying fuel to the combustion chamber is a fuel supply conduit connected to a source of combustible fuel at an upper end and having an lower end which extends within the central opening provided within the lower wall of the closed compartment.

12. The water heater of claim 10, wherein:

the lower end of the fuel supply conduit includes a plurality of radially extending fingers, each finger having an opening therein for supplying fuel to the central opening of the closed compartment at a location upstream of the pressure plate.

13. The water heater of claim 12, wherein:

the inner end of the fuel supply conduit also includes a plurality of fuel supply openings located on a downstream face of the pressure plate.

14. The water heater of claim 10, wherein:

the combustion chamber is provided with a flame tube which extends downward from the combustion means, the flame tube having an interior in which the combustible fuel is introduced from the combustion means to create products of combustion, the flame tube having a plurality of apertures for allowing passage of the products of combustion to an exterior of the flame tube.

15. The water heater of claim 10, wherein:

the inner wall is formed from a thermally conductive material to facilitate heat transfer to the annular reservoir for heating the water supply held within.

16. A method of heating water comprising the steps of:

providing an upright, closed tank formed from an outer tank shell having a top, a bottom and a generally cylindrical sidewall extending between the top and bottom to define an interior of the tank, the tank having a longitudinal axis extending between the top and bottom;

supplying combustible fuel to an upper portion of the tank and introducing the combustible fuel downward into a combustion chamber which is centrally located within the interior of the tank;

igniting the combustible fuel in the presence of air within the combustion chamber to create products of combustion;

providing a plurality of spray nozzles which are connected to a water supply to be heated, the spray nozzles being evenly spaced along the length and about the periphery of the combustion chamber;

directing water from the water supply transversely into the combustion chamber so that the water uniformly contacts the products of combustion within the combustion chamber so that the water is heated.

* * * * *